United States Patent [19]

Rouhani

[11] Patent Number: 4,667,421

[45] Date of Patent: May 26, 1987

[54] DETACHABLE HEEL FOR SHOES AND BOOTS

[76] Inventor: S. Zia Rouhani, 3028 Hartert Dr., Idaho Falls, Id. 83401

[21] Appl. No.: 856,367

[22] Filed: Apr. 28, 1986

[51] Int. Cl.[4] ..... A43B 21/36

[52] U.S. Cl. ..... 36/36 C

[58] Field of Search ..... 36/36 R, 36 A, 36 B, 36/36 C, 71.5, 15

[56] References Cited

U.S. PATENT DOCUMENTS

| | | | |
|---|---|---|---|
| 1,633,449 | 6/1927 | Mayorwitz | 36/36 C |
| 2,115,050 | 4/1938 | Teodorini | 36/36 C |
| 2,115,350 | 4/1938 | Teodorini | 36/36 C |
| 3,287,833 | 11/1966 | Rakus | 36/36 R |

FOREIGN PATENT DOCUMENTS

| | | | |
|---|---|---|---|
| 218699 | 2/1910 | Fed. Rep. of Germany | 36/36 C |

*Primary Examiner*—James Kee Chi

*Attorney, Agent, or Firm*—Thorpe, North & Western

[57] ABSTRACT

A shoe heel and sole structure composed mainly of two substrates or layers. The first substrate or layer is permanently attached to the shoe heel or sole, and the second substrate or layer comprises a wear layer that can be attached firmly to the first layer and removed easily for replacement. The first layer is in turn composed of two sublayers and has a number of small pocket-like cavities with openings for receiving the flat heads of pins or arbitrarily shaped protrusions, which are attached to the wear layer, i.e., the second layer. Furthermore, the first layer has a large central opening for receiving an attachment member of the wear layer. The combination of flat-headed pins and the attachment member of the wear layer are arranged such that they lock the wear layer securely to the first layer. Removal of the wear layer is achieved by folding back the attachment member out of the first layer and sliding the wear layer to disengage the flat-headed pins from the small pockets inside the first layer.

10 Claims, 26 Drawing Figures

DETACHABLE HEEL FOR SHOES AND BOOTS

BACKGROUND OF THE INVENTION

This invention relates to a heel and sole structure for shoes and boots that makes it easy to replace the worn-out wear layer of a heel or sole with a new wear layer in a quick and easy manner any number of times without the use of glue or nails to attach the new wear layer to the heel or sole.

It is known that heels and soles of shoes and boots wear out more rapidly than the other portions of the shoes or boots. Heretofore, repair has involved replacement of the worn-out layer using conventional methods of either gluing, sewing or nailing of the new wear layer to the soles or heels of the shoes or boots. This procedure is time consuming and rather costly. The repair work usually requires the use of hammer and nails and some other tools. The prior art repair work takes some time and cannot be done quickly. Generally, the shoes or boots must be left for some time with the person who is to do the repair work. The repair work is seldom done while the customer waits. There are numerous prior art patents relating to repair of shoes and boots, but there are only a few patents which have any resemblance to the present invention. None of the prior art patents disclose the full advantageous features of this invention. For example, U.S. Pat. No. 684,515 describes a detachable heel with flat-headed projections that would engage in some key-hole slots in the fixed layer of the heel, and a lug at the free end of a fixed spring that would engage into a hole in the detachable layer to hold it in a fixed position. A similiar structure was registered under U.S. Pat. No. 1,270,523 with the difference that a fixed transverse flange along the inner edge of the fixed heel is used to prevent the detachable layer from sliding out of its position. Another use of key-hole slots for detachable heels is found in U.S. Pat. No. 1,463,427, along with the suggestion of using struck-up parts in adjoining metal plates for holding the relative position of the wear-layer against the heel U.S. Pat. Nos. 2,115,050 and 2,115,350 suggest the use of a mounting member, or fixed layer, containing a plurality of sockets with key-hole openings that have beveled small portions for engaging flaring heads of coupling pins attached to the removable wear layer. As a mechanism for preventing disengagement of the wear layer, these Patents suggest the use of an upwardly projected lip on the detachable heel that would engage in a corresponding recess or opening inside the mounting member. Finally, U.S. Pat. No. 2,206,898 claims the idea of using a detachable tread heel, attached to a plate provided with a number of outwardly extended elements which are adapted to be engaged in corresponding open recesses in the fixed heel, and a central locking mechanism, composed of a leaf spring secured to the plate and a free end urged outwardly of the plate into a corresponding recess in the lower surface of the base heel Common disadvantages of the above referenced patents are: (a) necessity of using relatively thick layers of material, either in the wear layer or in the fixed (mounting) layer, for accomodating the locking mechanism and, (b) the practical difficulties of inserting and removing the detachable layer. In particular, regardless of the mechanism used to keep the wear layer in its place, after a period of usage and subjection to pressure due to weight bearing, the wear layer adapts so tightly to the heel or sole structure that its removal requires considerable force for displacement. None of the referenced patents provides a means to ease this phase of replacement.

OBJECTS AND SUMMARY OF THE INVENTION

The present invention relates to a heel and/or sole structure that is composed of two main layers. The first layer, which is to be attached permanently to the ordinary heel or sole of shoes or boots, has a number of pocket-like cavities spaced around the periphery thereof, with the cavities having openings shaped so as to have a large part and a narrow part. The first layer also has a larger open cavity in its central portion. The second layer, called the wear layer, is equiped with a number of flat-headed pins in positions corresponding to the narrow parts of the openings in the fixed layer. In its central portion, the wear layer has a cut and hinged portion that can be folded out (downward) and is shaped to fit inside the open cavity of the fixed layer when in its unfolded normal position. The free end of the hinged, foldable piece has a thinner edge that resides above the main body of the wear layer to be received inside the central cavity of the fixed layer. The combination of the flat-headed pins and the hinged, foldable central piece hold the wear layer firmly attached to the fixed layer. The hinged, foldable pieces of the wear layer are equipped with small rectangular openings for insertion of a tool, such as a screwdriver, to fold out the pieces and to move the wear layer relative to the fixed one, in order to disengage the pins and to remove the wear layer for its replacement.

A principal objective of this invention is to provide a practical heel and/or sole structure which facilitates the task of removing the worn layer of material from under the shoe and replacing it with a new one. Another objective is to provide an improvement in heel and sole construction adaptable for making new shoes and boots or as an attachment to existing shoes and boots. A further objective of this invention is to provide a heel and sole structure with a thin and, in the case of heels, slightly wedge-shaped fixed layer such that its attachment to a shoe or boot does not add considerably to the heel height, and hence, retains the original form of the shoe or boot. A still further objective resides in the provision of an improved structure of the wear layer which is not undesirably thick and bulky, such that the new replacement heel or sole structure is practical and forms an attractive repair for fine dress shoes and boots, as well as for any other type of shoe or boot.

Additional objectives and features of the present invention will become apparent from the following detailed description, taken together with the accompanying drawings.

THE DRAWINGS

Preferred embodiments of the present invention representing the best modes presently contemplated of carrying out the invention are illustrated in the accompanying drawings, in which.

DETAILED DESCRIPTION OF THE INVENTION

The following description will describe two preferred embodiments of novel wear structure for the heel and sole of a shoe or boot. The structure will first be described with respect to the heel of a shoe or boot, and then the structure will be described with respect to the sole of a shoe or boot.

Figure 1:
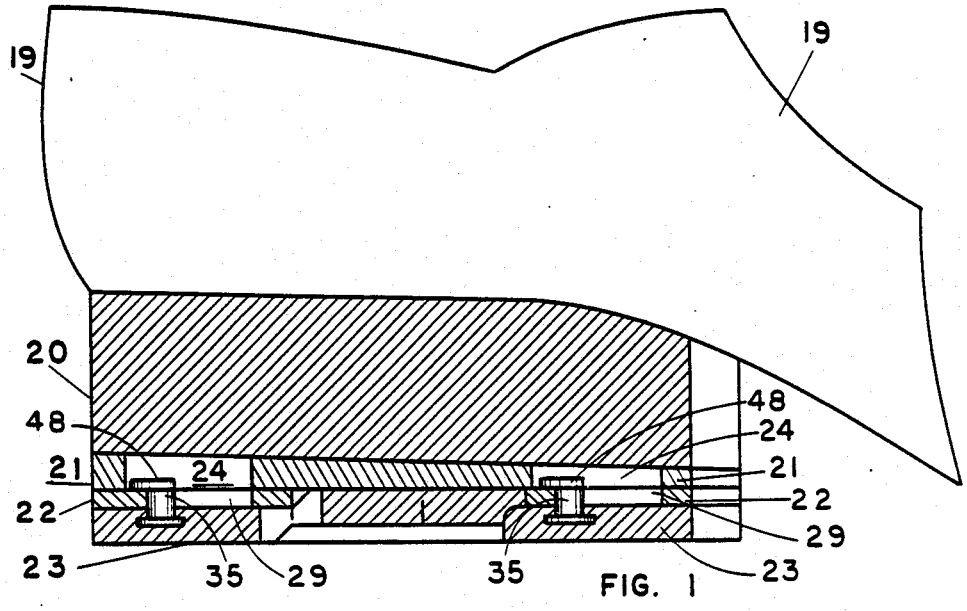
FIG. 1 is a vertical cross-section of the novel wear structure in accordance with the present invention as applied to the heel of a shoe or boot.

FIG. 1 shows the rear portion of an ordinary shoe 19 and particularly the heel 20 which incorporates the novel wear structure of the present invention. The heel portion 20 of FIG. 1 is a vertical cross-section, and shows the wear structure to comprise heel structure, according to the present invention, composed of three layers 21, 22 and 23. The two first layers, 21 and 22, are integrally attached to each other and securely affixed to the heel 20 permanently by nailing or gluing either in shoe manufacturing process or later on. The third layer 23 is the wear layer that can be attached to the middle layer 22, and removed or replaced when necessary. All the three layers 21, 22 and 23 have a matching outside contour such that when stacked in that order they appear as an integral part of the heel 20.

Figure 2:
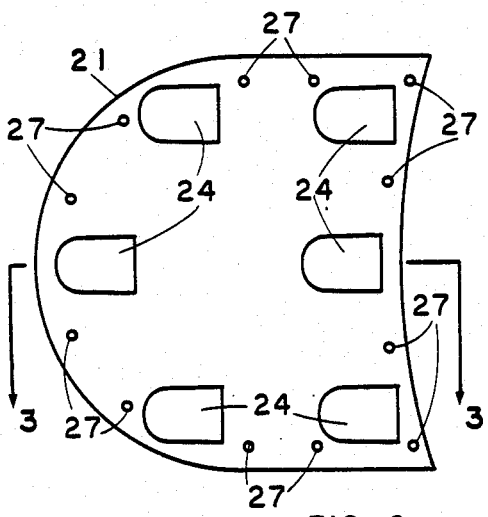
FIG. 2 is a horizontal top view of the upper sublayer of the composite first or fixed layer of the wear structure of FIG. 1.

FIG. 2 shows a horizontal view of layer 21. This layer, which can be made of leather, rubber, plastic, or any other solid material, has a number of openings 24, which serve as cavities for housing the top parts 48 of the attachment means or pins 35 that extend from the wear layer 23. The wear layer 23 is shown in FIGS. 7–12. The pins 35 are firmly attached to the wear layer 23. As illustrated, the inner ends of the pins 35 are embedded in the wear layer 23. The layer 21 has also a number of small holes 27 which are made for nailing this layer to the shoe heel 20.

Figure 3:
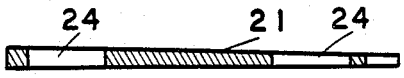
FIG. 3 is a vertical cross-section of the upper sublayer of FIG. 2 taken along line 3—3 of FIG. 2.

FIG. 3 shows the vertical cross-section of layer 21, indicating its slight wedge-shaped thickness for better accomodation of the added height to the shoe heel. The thickness of this layer may vary from about 0.025 inch to 0.125 inch, depending on the type of shoe. As shown in FIGS. 2 and 3, the openings 24 are spaced around the perimeter of the layer 21 and extend through the thickness of the layer 21.

Figure 4:
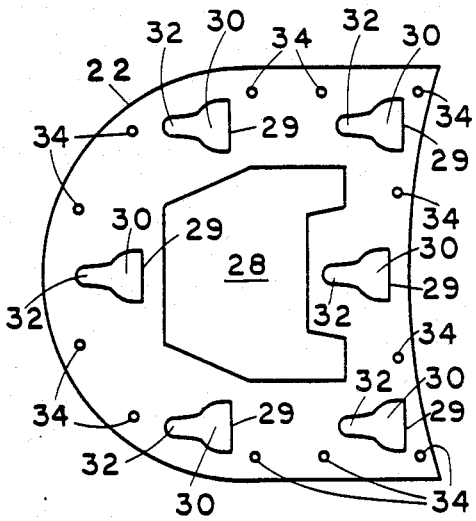
FIG. 4 is a horizontal top view of the lower sublayer of the composite first or fixed layer of the wear structure of FIG. 1.

FIG. 4 shows a horizontal top view of the middle layer 22. This layer is characterized by a large central opening 28, and a number of smaller openings 29, spaced around its periphery. The central opening 28 may have any arbitrary shape, but a suitable one may be composed of regular geometrical elements such as trapezoids and rectangles, as shown in FIG. 4 or a half-circle and a rectangle as will be shown later.

The openings 29 are generally smaller than the openings 24 in layer 21, and the openings 29 are formed like a truncated key-hole composed of a larger base portion 30 and a smaller extension portion 32. As shown in FIG. 4, all the openings 29 are oriented in parallel, with their smaller sections 32 pointing in one direction. The small openings 29 may, of course, have some other geometrical shape, such as a square or rectangle, or a combination of a rectangle and a half-circle etc. Any of such geometrical shapes may serve the purpose of the small openings 29 in this invention and the choice of this shape is immaterial to the implementation of the invention. An alternative form of these openings, for a different type of pin, will be described later.

The middle layer 22 has also a number of very small holes 34 for nailing this layer together with layer 21 to the shoe heel. The nailing holes 34 are positioned such that they coincide with the nailing holes 27 of layer 21 when the two layers are matched together.

Layer 22 has a uniform thickness of about 0.025 to 0.1 inch and should be made of a hard plastic or metal or any other structuraly stable and stiff material.

Figure 5:
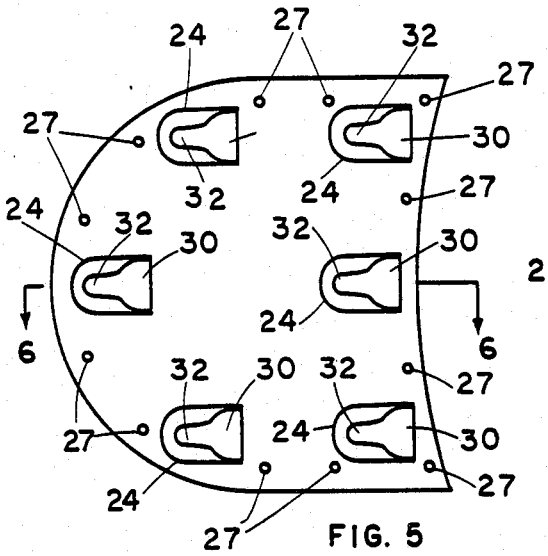
FIG. 5 is a top view of the two sublayers of FIGS. 2 and 4 when they are superimposed and joined together to form the composite first or fixed layer of the wear structure of FIG. 1.

As shown in FIG. 4, the small openings 29 of layer 22 are positioned around its periphery such that each one of the respective openings 29 will be immediately adjacent to a corresponding opening 24 in layer 21. The openings 29 form a keyhole type opening to the larger openings or cavities 24 which are otherwise closed cavities when the two layers 21 and 22 are stacked together as best shown in FIG. 1. As shown in FIG. 5, the openings 29 align up directly beneath the openings 24 when the layers 21 and 22 are properly positioned.

Figure 6:
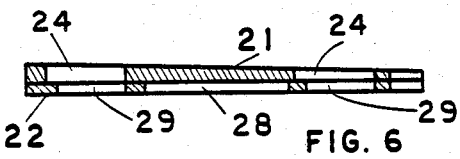
FIG. 6 is a vertical cross-section of the composite first or fixed layer taken along line 6—6 of FIG. 5.

FIG. 6 shows a vertical cut through the center line of the stacked layers 21 and 22. As indicated in FIGS. 1, 5 and 6 the openings 24 in layer 21 provide a pocket-like cavity above and around the openings 29 in layer 22 when the layers 21 and 22 are properly positioned in stacked alignment with each other. The pocket-like cavities formed by openings 24 are adapted to house the flat heads of pins attached to the wear layer, as will be explained later.

Obviously, in a manufacturing process the combination of layers 21 and 22, as shown in FIGS. 5 and 6, may be produced as a single piece. Furthermore, the combination of layers 21 and 22, according to FIGS. 5 and 6 may be produced as an integral part of the heel 20 in the shoe manufacturing process. In the latter case, there will be no need for providing the nailing holes 27 and 34 in the two layers.

Figure 9:
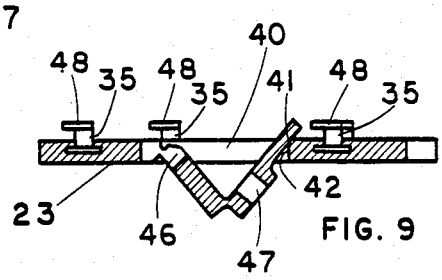
FIG. 9 is a vertical cross-section of the second or wear layer similar to FIG. 8 but showing the central, cut and hinged portion thereof in its folded position
Figure 7:
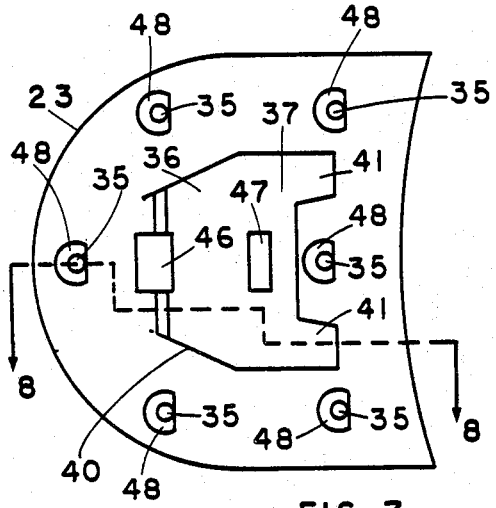
FIG. 7 is a top view of the second or wear layer of the wear structure of FIG. 1
Figure 8:
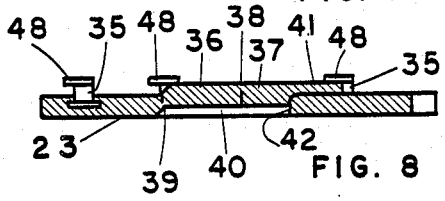
FIG. 8 is a vertical cross-section of the second or wear layer taken along the line 8—8 of FIG. 7.

FIG. 7 shows a top view of the wear layer 23. The wear layer 23 has a number of flat headed pins 35 attached thereto so as to extend from the upper surface of the wear layer. The flat headed pins 35 are positioned such that each one of them will fit into one of the corresponding smaller portion 32 of the small keyhold type openings 29 in layer 22 when the wear layer is positioned adjacent the layer 22 in the heel construction. The pins 35 form attachment members which combine with a movable central piece for firmly affixing the wear layer to the heel by way of the layer 22. The pins 35 have flat heads 48. As shown in FIGS. 8 and 9, layer 23 has a movable central piece composed of two segments 36 and 37, connected together by a hinge 38 at their upper surface and attached to the wear layer 23 through another hinge 39 near the lower surface. Both hinges 38 and 39 may consist of merely a thinner layer of the same material as the wear layer itself. The main portions of the foldable pieces 36 and 37 of the central piece are received in the central opening 40 in the wear layer 23 as shown in FIGS. 7 and 8. The thickness of the main body of the wear layer 23 may be anywhere from 0.1 to 0.5 inch, depending on the type of shoe or boot on which the wear layer 23 is to be applied.

As shown in FIG. 8, the foldable central pieces 36 and 37 have an extra thickness which extends above the upper surface of layer 23. Also, as shown in FIGS. 7, 8 and 9, the forward half of the folding piece 37 has a thinner part 41 which extends beyond the edge 42 of the opening 40 and rests entirely on top of the wear layer 23 when the pieces 36 and 37 are aligned inside opening 40 in the wear layer. The thickness of the extended piece 41, as well as the upward projected extra thickness of the pieces 36 and 37 are equal to the thickness of layer 22 or, generally, equal to the depth of the central cavity in the fixed layer. Furthermore, as shown in FIG. 7, the combined outer periphery of the upward projected portions of pieces 36 and 37, including the extended portion 41, has the same shape as the central opening 28 of layer 22 and, together, the projected parts fit snugly inside the opening 28, when the upper surface of layer 23 is in contact with the lower surface of layer 22, as shown in FIG. 1.

Also, as shown in FIGS. 7 and 9, there are two rectangular openings 46 and 47 in the folding pieces 36 and 37 respectively. The purpose of these openings is to facilitate lifting up the folding pieces for detachment of the wear layer, as will be explained later.

As shown in FIGS. 7, 8 and 9, the flat-headed pins 35 are integral parts of the wear layer 23. Each pin 35 is fixed to the wear layer 23 at its lower end and has an upper part which is composed of a rounded stem 35. The lower portion of the stem 35 is preferably firmly imbedded in the layer 23. The stems 35 extend from the layer 23 with a height equivalent to the thickness of layer 22. The stems 35 have a cross sectional dimension or diameter that can easily slide into the smaller narrow portion 32 of the openings 29 of layer 22. Each pin 35 has a flat head 48 at the free end of the stem 35. The flat heads 48 have a larger dimension than the stems 35, and each flat head 48 is adapted to fit inside the opening 24 of layer 21 through the larger portion 30 of opening 29 of layer 22. When the stems 35 are then moved into the smaller portion 32 of the openings 29, the flat heads 48 are locked into the cavity formed by opening 24 in layer 21.

In an alternative manufacturing process, the flat-headed pins 35 may be of the same material as layer 23 and they could be formed together in one piece. Furthermore, the pins 35 may have other shapes or cross-sections than described above. An example of an alternative design of pins 35 and their corresponding openings in layer 22 will be shown later.

In order to attach the wear layer 23 to the fixed layer 22, the central pieces 36 and 37 of the central locking piece are folded down, as shown in FIG. 9, and the flat heads 48 of pins 35 are inserted into holes 29 of layer 22, bringing the wear layer into snug contact with layer 22. Next, the wear layer 23 is slid along the surface of layer 22 until the pins 35 rest against the forward ends of the smaller portions 32 of the openings 29 in layer 22. In this position, the central pieces 36 and 37 of the central locking piece of the wear layer 23 are pressed back and unfolded so as to insert the extention 41 into the gap between layers 22 and 23, as best shown in FIG. 1. Once in this position, the extention 41 keeps the hinged pieces alinged or very slightly bent upwards and, as a result, the flatly aligned pieces 36 and 37 fits snugly in the corresponding opening 28 of layer 22 and provides a solid supprot to carry any forces in forward direction from the wear layer 23 to the fixed layer 22 as well as to prevent any sliding displacement of the wear layer 23 relative to the layer 22. The pins 35 lodged in their positions also prevents any movement of the wear layer 23 and together with the central locking piece securly lock the wear layer 23 to the fixed layer 22. In this manner, the wear layer 23 is firmly locked into its position affixed to the heel.

To remove a worn layer 23, one may insert a tool such as the tip of a screwdriver or a pocket-knife into the opening 47 in the flat piece 37 of the central locking piece to fold the pieces 36 and 37 downwardly into a position as shown in FIG. 9 and thereby pull extention 41 out of its position. One can then slide the wear layer 23 forward and disengage the flat-headed pins 35 from the openings 29 in the fixed layer 22. To facilitate sliding of the wear layer 23 against the fixed layer 22, the tip of a wide screwdriver may be twisted inside opening 46 of flat piece 36 of the central locking piece. This will force the central locking piece and the entire wear layer 23 to move relative to the fixed layer 22. After disengaging the flat-headed pins 35 from the key-hold openings 29, the wear layer 23 can be removed and replaced with a new one.

Figure 10:
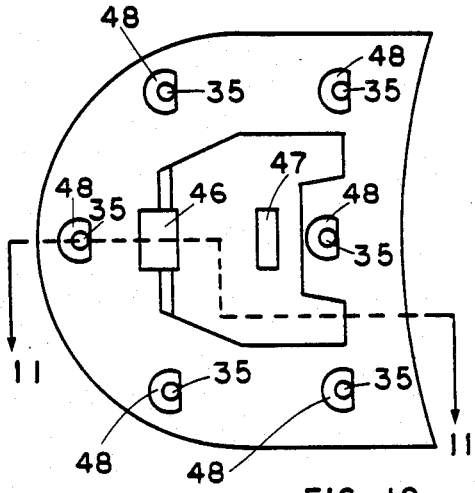
FIG. 10 is a top view of a second or wear layer similar to that of FIG. 7 showing a slightly modified central cut portion which is bendable rather than hinged.
Figure 11:
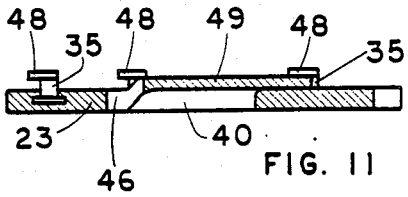
FIG. 11 is a vertical cross-section of the second or wear layer of FIG. 10 taken along the line 11—11.
Figure 12:
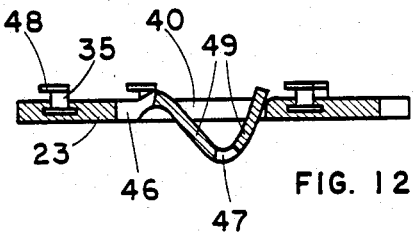
FIG. 12 is a vertical cross-section of the second or wear layer of FIG. 10 similar to FIG. 11 but also showing the central cut portion in its bended and folded position.

In an alternative implementation of this invention, the folding pieces 36 and 37 of the central locking piece are replaced with a single piece 49, shown in FIGS. 10 and 11, that is made of a resilient material and can be bent out of its straight position as shown in FIG. 12. As shown in FIGS. 10 and 12, the bending central piece 49 is provided with two openings 46 and 47 that are needed to facilaitate removal of the wear layer as described in the case of folding pieces 26 and 27 described hereinbefore.

Figure 13:
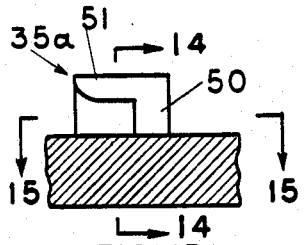
FIG. 13 is an enlarged side view of a T-shaped embodiment of an attachment pin on the second or wear layer of the wear structure of FIG. 1.
Figure 14:
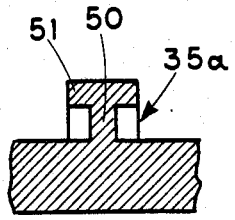
FIG. 14 ,is a vertical cross-section of the T-shaped pin of FIG. 13 taken on line 14—14 of FIG. 13.
Figure 16:
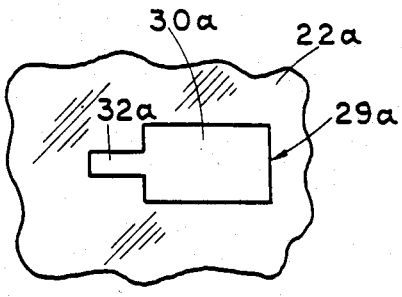
FIG. 16 is an enlarged portial plan view of an opening hole in the first or fixed layer which is adapted to receive the T-shaped pin of FIG. 13.
Figure 15:
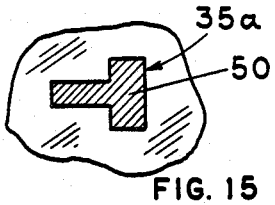
FIG. 15, is a horizontal cross-section of the T-shaped pin of FIG. 13 taken on line 15—15 of FIG. 13.

As stated earlier, the openings 29 in layer 22 and the pins 35 in the wear layer 23 may have some other shape and cross-section for the purpose of this invention. FIG. 13 shows an alternative type of pin **35*a* which has a T-shaped cross-section as shown in FIGS. 14 and 15. This pin 35*a* is composed of a T-shaped vertical part 50, with a height equal to the thickness of layer 22, and a flat top 51 that rests on layer 22. As implied in FIG. 14, this type of pin is particularly suitable for being manufactured as an integral part of the wear layer 23. FIG. 16 shows the opening 29*a* in layer 22*a* that matches the T-shaped pin 35*a*. The smaller portion 32*a* in the opening 29*a* can be formed with straight sides as shown in FIG. 16 or it could be shaped more nearly like portions 32 of the opening 29 shown in FIG. 4. The larger portion 30*a* in the opening 29*a* preferably has straight sides and a rectangular shape as shown in FIG. 16**.

Figure 19:
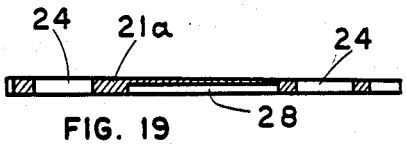
FIG. 19 is a vertical cross-section of the upper sublayer of FIG. 18 taken along line 19—19 of FIG. 18.
Figure 17:
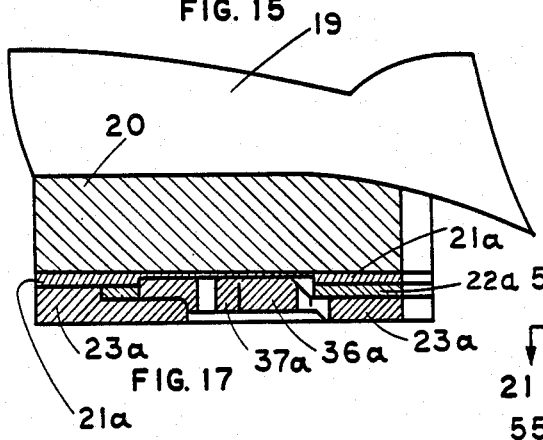
FIG. 17 is a vertical cross-section of an alternative embodiment of novel wear structure similar to that of FIG. 1.
Figure 20:
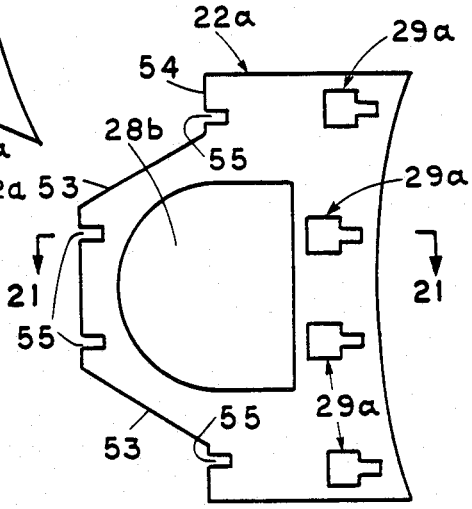
FIG. 20 is a horizontal top view of the lower sublayer of the composite first or fixed layer of the wear structure of FIG. 17.
Figure 18:
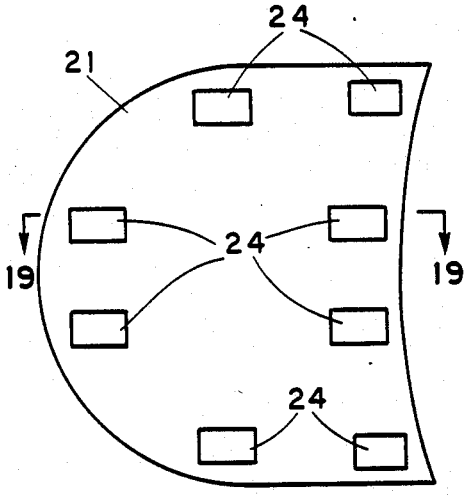
FIG. 18 is a horizontal top view of the upper sublayer of the composite first or fixed layer of the wear structure of FIG. 17.
Figure 21:
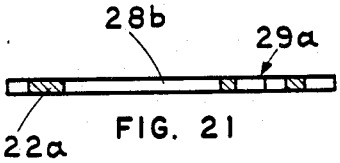
FIG. 21 is a vertical cross-section of the lower sublayer of FIG. 20 taken along line 21—21 of FIG. 20.
Figure 22:
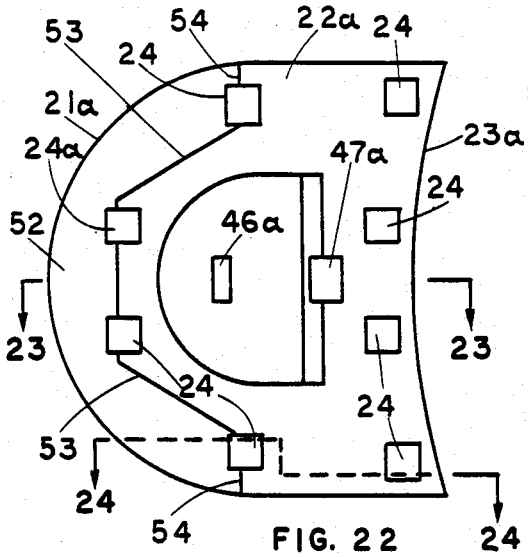
FIG. 22 is a top view of the second or wear layer of the wear structure of FIG. 17.
Figure 23:
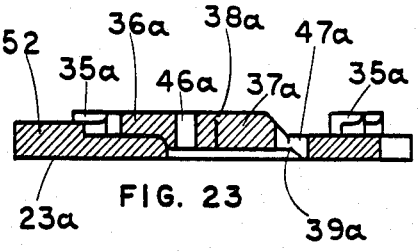
FIG. 23 is a vertical cross-section of the second or wear layer taken along line 23—23 of FIG. 22.
Figure 24:
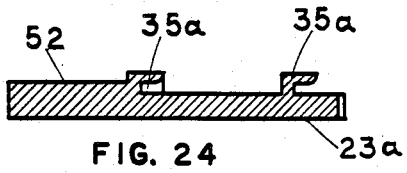
FIG. 24 is a vertical cross-section of the second or wear layer taken along line 24—24 of FIG. 22.

FIG. 17 shows a vertical cross-section of an alternative embodiment of the present invention. In this particular arrangement, the upper fixed layer **21*a* has a central recessed cavity 28*a* as shown in FIG. 19. This cavity 28*a* matches the opening 28*b* (FIG. 20) in layer 22*a* (FIG. 20) and provides additional depth for housing the central pieces 36*a* and 37*a* of the wear layer 23*a*. In this embodiment, the middle layer 22*a*, shown in FIG. 20, has some cut portions toward the rear side of the heel. The space created by these cuts is filled with an extra thickness 52 of the wear layer 23*a*, as shown in FIGS. 17, 23, and 24. This feature is the main difference between the alternative and the base version described earlier. The boundry between the cut portions of layer 22*a* and layer 23*a* is composed of straight lines 53 and 54 as shown in FIGS. 20 and 22. There are a number of engagements, or notches 55 along the boundry lines in layer 22*a*, shown in FIGS. 20 and 21, for housing the central part of attachment pins extending from the wear layer 23*a*. These pins are not shown in FIGS. 17–21 although they are similar to pins 35 of FIGS. 1 and 7–12. Furthermore, layer 22*a* has also a number of openings 29*a*, shown in FIGS. 20 and 21, for insertion and engagement of other similar pins attached to the wear layer. As in case of the base version, the combination of layers 21*a* and 22*a*** may be manufactured as a single piece.

An alternative embodiment of a wear layer **23*a* is shown in FIGS. 22–24. The alternative wear layer 23*a* has a number of pins 35*a* (FIGS. 23 and 24) around its periphery. The pins 35*a* in the rear part are partially merged with the extra thickness 52 of this layer as shown on vertical cross-sections in FIGS. 23 and 24. The central pieces 36*a* and 37*a* (FIG. 23) are connected to the main body of the wear layer 23*a* along the hinge 39*a*, towards the front end of the heel. The function of these central pieces 36*a* and 37*a* is the same as explained earlier with respect to flat pieces 36 and 37 of the central locking piece of the base version. They can be folded down and out of their housing for insertion and removal of the wear layer 23*a*. The two central pieces 36*a* and 37*a* that are shown hinged together along 38*a* FIG. 23, are provided with openings 46*a* and 47*a* respectively. As described in the case of the base version, the function of these openings 46*a* and 47*a* in the folding pieces is to facilitate application of a tool, such as a screwdriver, in folding up the pieces and forcing the wear layer 23*a*** to slide out of its engagement with the fixed layer of the construction.

Figure 25:
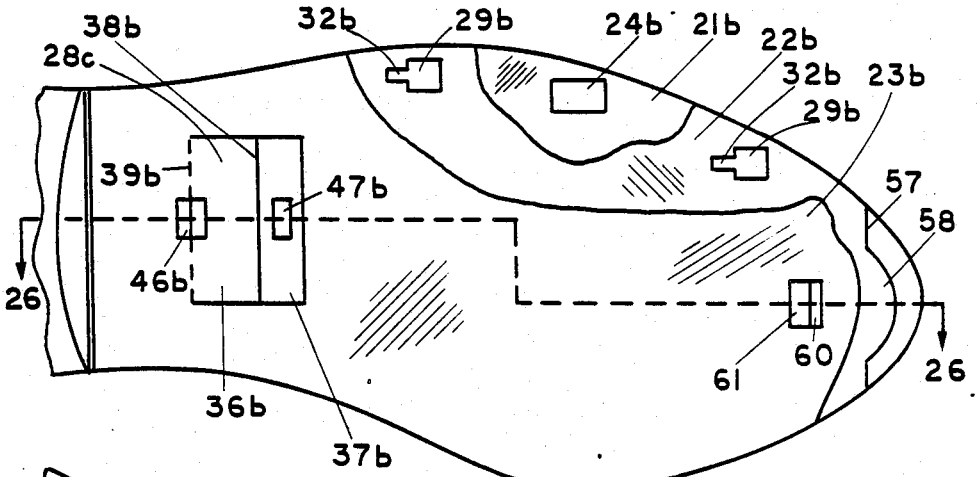
FIG. 25, is a bottom plan view of a shoe sole which incorporates the novel wear structure in accordance with the invention, with portions of the structure broken away to show the openings in the sublayers of the first or fixed layer of the structure
Figure 26:
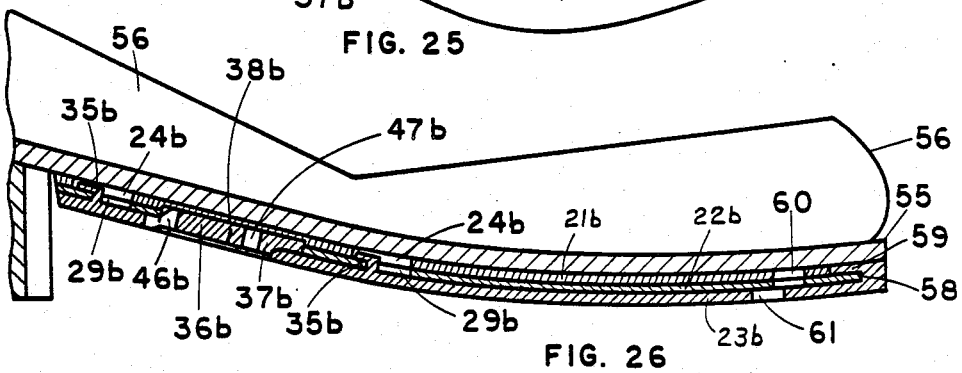
FIG. 26 is a vertical cross-section of the shoe sole structure of FIG. 25 taken along line 26—26 of FIG. 25.

The descriptions of the foregoing embodiments of the fixed and detachable layers, and their alternative embodiments for the heel structure, apply equaly well to a shoe sole structure. In FIG. 25 there is shown a bottom view of a sole structure which incorporates the novel wear structure according to the present invention. For simplicity, superposition of the three layers **21*b*, 22*b* and 23*b* are shown in FIG. 25. These layers correspond to the layers 21, 22, 23 or 21*a*, 22*a* and 23*a*, respectively, in the heel structures illustrated in FIGS. 1–24. A cross-section of the sole structure of FIG. 25 is shown in FIG. 26. Layers 21*b* and 22*b* are permanently attached to the ordinary sole 55 (FIG. 26) of the shoe 56, by nails or with glue. These two layers may be produced as a single piece in manufacturing or, alternatively, the combination of layers 21*b* and 22*b* may be made an integral part of the sole 56** in shoe manufacturing.

As shown in FIG. 25, layer **21*b* has a number of small rectangular cavities 24*b* that are partially covered by corresponding openings 29*b* in layer 22*b*. There is also a larger rectangular cavity 28*c* in the rear part of the sole. This cavity houses the folding pieces 36*b* and 37*b* of the wear layer 23*b*. In similarity with the wear layer 23 or 23*a* in the case of the heel structures described previously, the wear layer 23*b* for the sole has a number of pins 35*b* that can be engaged in the narrow parts 32*b* of the openings 29*b*, with their flat heads inside cavities 24*b*. The wear layer is also equipped with the folding pieces 36*b* and 37*b*, hinged together along 38*b*, and hinged to the wear layer along 39*b*. Like in the case of heel structure, these folding pieces fit snugly inside the cavity 28*c*** and lock the wear layer against any movement forward.

Also in this application, the folding pieces **36*b* and 37*b* have openings 46*b* and 47*b*, respectively, for easing the task of folding out the folding pieces 36*b* and 37*b* and sliding the wear layer 23*b*** away from its engagement.

Furthermore, as shown in FIGS. 25 and 26, an additional rectangular hole or cavity 60 is provided in layers **21*b* and 22*b*, close to the tip end of the sole. Cavity 60 is partially covered with a rectangular hole 61 in the wear layer 23*b*. The overlapping opening between cavity 60 and hole 61** provides an additional facility for using a wide-tip screwdriver to force the wear layer out of its engagement.

A special feature of the sole structure is the extra thickness and engagement mechanism for the tip part of the sole. These are shown in FIGS. 25 and 26. Layer **21*b* is cut short, about 0.75 inch, along the straight line 57, and layer 22*b* has a small, rounded extension 58 beyond that line. The wear layer 23*b* has a picket like cavity at the front end which houses the extension 58 of layer 22*b* and fills the space 59 created by the cut in layer 21*b***.

This arrangement provides a firm attachment and a thicker material at tip of the sole where it is more subject to wear. The attachment and removal of the wear layer 23*b* of the sole is according to the same procedure as described for the base case of the heel structure. The additional gap between rectangular holes 60 and 61 provides a needed extra facility for using a screwdriver in the removal operation.

It is to be understood that the present disclosure, including the detailed description of several preferred emobidments of the invention, is made by way of example and that other embodiments are possible without departing from the subject matter coming within the scope of the following claims, which subject matter is regarded as the invention.

I claim:

1. In a heel structure for shoes and boots in which the heel structure includes a replaceable wear layer which is removably attached to a mounting layer that is firmly affixed to the heel structure, the improvement in the means for removably attaching the wear layer to the mounting layer, said improvement comprising in combination a plurality of openings in the mounting layer, said openings being spaced around the periphery of the mounting layer;

a plurality of entrance means, with each of the respective entrance means being associated with a mutually respective opening in the mounting layer, whereby the openings in said mounting layer open downwardly through a respective entrance means to the lower side face of said mounting layer which faces away from the heel structure of the shoe or boot;

a central cavity in said mounting layer, said central cavity opening downwardly to said lower side face of said mounting layer;

a plurality of engagement members extending from the upper surface of said wear layer, said engagement members being spaced and positioned on said wear layer such that each engagement member releasably engages a mutually respective entrance means and opening in the mounting layer, whereby the wear layer can be secured to the mounting layer by insertion of the engagement members into mutually respective entrance means and openings in said mounting layer and laterally moving the wear layer and engagement members relative to the mounting layer so that the engagement members make releasable engagement with the entrance means on said openings in the mounting layer and further whereby the wear layer can be removed from the mounting layer by laterally moving the wear layer and engagement members to disengage the engagement members from the mutually respective entrance means and then withdrawing the engagement members from the mutually respective entrance means and openings in said mounting layer;

a central hinged member on said wear layer, said central hinged member being hingedly attached along one side thereof to said wear layer, with said central hinged member further having at least a portion thereof lying above the upper surface of said wear layer, with said portion of said central hinged member which lies above the upper surface of said wear layer having a shape which fits snugly within said central cavity in said mounting layer when the wear layer is moved laterally into its position in which the engagement members make engagement with the entrance means on the openings in said mounting layer, whereby the reception of said portion of said central hinged member in said central cavity prevents unintended movement and disengagement of said wear layer from said mounting layer; and means on said central hinged member for pivotally moving said central hinged member downwardly about its hinged attachment to said wear layer whereby said upper portion of said central hinged member is sufficiently withdrawn from said central cavity so that the wear layer can be moved and disengaged when desired from said mounting layer.

2. A heel structure in accordance with claim 1, wherein said wear layer has a central opening therein, and said central hinged member is hingedly attached along one of its side edges to a mutually respective side edge of said central opening in said wear layer.

3. A heel structure in accordance with claim 2, wherein said wear layer and said central hinged member are molded as an integral unit from a moldable polymeric material, and the hinged attachment of the central hinged member to said wear layer comprised an integral molded juncture between the wear layer and the central hinged member, with said central hinged member being bendable in a hinge movement about said hinged attachment.

4. A heel structure in accordance with claim 3, wherein the free end of said central hinged member extends slightly beyond the side edge of said central opening in said wear layer which is opposite to the side edge of said central opening to which said central hinged member is attached.

5. A heel structure in accordance with claim 2, wherein said wear layer and said central hinged member are molded as an integral unit from a moldable polymeric material, and the hinged attachment of the central hinged member to said wear layer comprises a thinned hinge section molded integrally between the wear layer and the central hinged member.

6. A heel structure in accordance with claim 5, wherein said central hinged member comprises first and second segments, which are hingedly attached to each other, with said first segment being attached to said wear layer by said hinged attachment and with said first and second segments being attached together along a hinge line which is parallel with said hinged attachment of said first segment to said wear layer.

7. A heel structure in accordance with claim 6, wherein the free end of said second segment of said central hinged member extends slightly beyond the side edge of said central opening in said wear layer which is opposite to the side edge of said central opening to which said first segment of said central hinged member is hingedly attached.

8. A heel structure in accordance with claim 7, wherein said means on said central hinged member for pivotally moving said central hinged member comprises an opening in said second segment of said central hinged member into which the tip of a prying tool, such as a screwdriver, can be inserted for pivotally moving said central hinged member.

9. A heel structure in accordance with claim 8, wherein an opening in said first segment of said central hinged member adjacent to the hinged attachment of said first segment to said wear layer into which the tip of a prying tool, such as a screwdriver, can be inserted to pry the wear layer in a lateral movement with respect to the mounting layer during disengagement and removal of the wear layer from the mounting layer.

10. A heel structure in accordance with claim 1, wherein the mounting layer has a reduced thickness adjacent to the rear side of the heel, and further wherein the wear layer has an increased thickness to correspond with the reduced thickness of the mounting layer, with the increased thickness of said wear layer providing additional wear material where wear on the heels tends to be greatest.

* * * * *